US005469979A

United States Patent [19]

Chiou

[11] Patent Number: 5,469,979

[45] Date of Patent: Nov. 28, 1995

[54] ADJUSTABLE SEALED CAN

[76] Inventor: Wen-Nen Chiou, 1-25, Gun Cao, Gun Nan Tsueng, An-Tin Hsiang, Tainan Shien, Taiwan

[21] Appl. No.: 326,845

[22] Filed: Oct. 21, 1994

[51] Int. Cl.[6] ..... B65B 31/04; B65D 21/08

[52] U.S. Cl. ..... 215/228; 220/212; 220/625; 141/65; 417/552

[58] Field of Search ..... 215/228, 231; 220/231, 212, 625, 8; 206/624.8; 141/65; 417/552, 555.1, 234, 437, 544; 217/86; 222/386

[56] References Cited

U.S. PATENT DOCUMENTS

| | | | |
|---|---|---|---|
| 2,690,080 | 9/1954 | Rich | 222/386 X |
| 4,019,629 | 4/1977 | Dubner et al. | 417/555.1 X |
| 4,278,114 | 7/1981 | Ruberg | 141/65 |
| 4,287,819 | 9/1981 | Emerit | 417/555.1 X |
| 4,362,095 | 12/1982 | Wheatley | 206/524.8 X |
| 5,390,809 | 2/1995 | Lin | 220/212 |

*Primary Examiner*—Allan N. Shoap
*Assistant Examiner*—Nathan Newhouse

[57] ABSTRACT

An adjustable sealed can comprising a can body having an top opening for a cap to close on and a bottom opening defined by a circumferential inwardly extending short wall closed by a bottom plate movable upward and downward in a hollow interior, the cap having an elongate block on top provided with a pumping chamber for a pumping rod to fit and reciprocate therein to pump out the air in the can body through an air valve fitted in a vertical valve hole in the inner end of the pumping chamber by manual reciprocating movement of the pumping rod, with the movable bottom plate being moved up as food stored in the can body is gradually taken out and the air therein pumped out.

5 Claims, 5 Drawing Sheets

ADJUSTABLE SEALED CAN

BACKGROUND OF THE INVENTION

This invention concerns an adjustable sealed can, particularly one having a movable bottom plate for forcing the air in the can body to flow out thereof, by actuating a pumping rod to make the interior of the can body become almost vacuum for keeping food placed therein fresh for a long period of time.

Conventional sealed containers often generally have a container and a cap closed tightly on an upper opening of the container for keeping food, and preventing air from flowing into the container. However, some air remains therein when the cap is sealed on the container, and this can cause the food therein to change its quality, and, also become rotten after a long period of time.

SUMMARY OF THE INVENTION

The purpose of this invention is to offer an adjustable sealed can for keeping food fresh or in good condition for a long period of time.

An adjustable sealed can in the present invention comprises a can body having an upper opening closed with a cap, a bottom opening closed by a movable bottom plate which moves up and down in an hollow interior of the can body and having an annular groove for a gasket to fit therein, and a circumferential sidewise short wall provided at the bottom of the can body to stop the bottom plate. The cap has an elongate block on top provided with a pumping chamber for a pumping rod to fit and reciprocate therein. The pumping rod has a grip at an outer end and an inner end portion provided with an annular groove for an annular gasket to fit therein. An air valve is provided in a vertical hole at an inner end of the pumping hole, the hole having a valve base provided with a center through hole for a stopper to fit therein and be elastically urged down by a spring. An anti-leak gasket is provided around an inner upper wall of the cap to prevent air from flowing therethrough after the cap is closed on the can body.

DETAILED DESCRIPTION OF THE INVENTION

Figure 1:
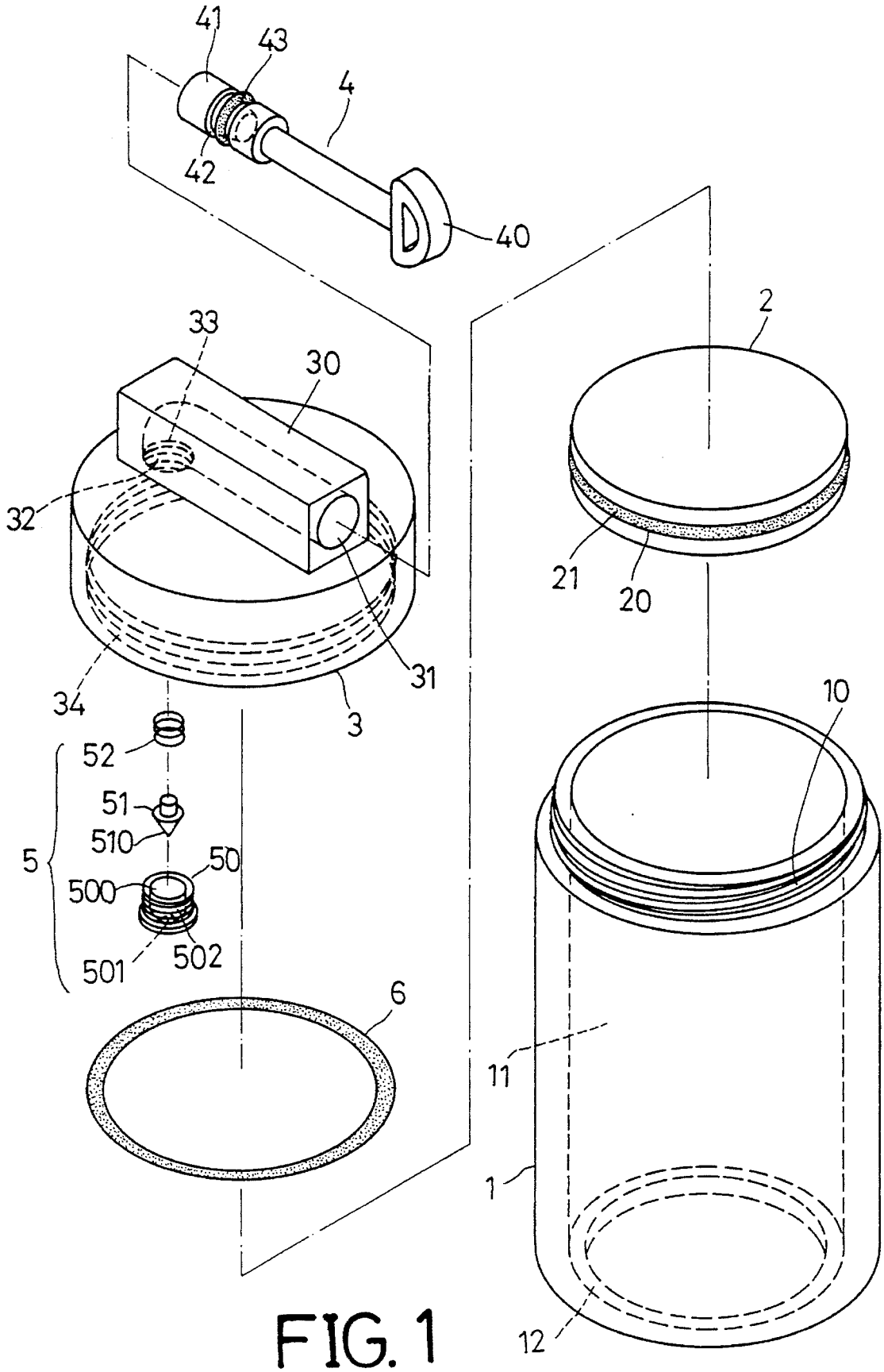
FIG. 1 is an exploded perspective view of an adjustable sealed can in the present invention.

An adjustable sealed can in the present invention, as shown in FIG. 1, comprises a can body 1, a movable bottom plate 2, a cap 3, an elongate pumping rod 4, an air valve 5 and an anti-leak gasket 6 as its main components combined together.

The can body 1 has an upper opening and a bottom opening, a male thread 10 around its upper inner circumference, a hollow interior or chamber 11 and, an annular inwardly extending stop wall 12 defining the bottom opening.

The movable bottom plate 2 is shaped to fit tightly in the hollow interior 11 and able to move up and down therein, and has an annular groove 20 around its circumference and an annular gasket 21 tightly fitted in the annular groove 20 to tightly contact the inner wall of chamber 11.

The cap 3 has a female thread 34 in an inner wall to engage the male thread 10 of the can body 1 to close the top of the can body 1, an elongate lateral block 30 on its top, provided with a longitudinal pumping chamber 31, and a valve hole 32 extending down from a bottom end of the chamber 31 and having a female thread 33.

The elongate pumping rod 4 is slidably received in the pumping chamber 31 of the elongate block 30 of the cap 3, moving therein inward and outward, and having a pulling grip 40 at an outer end, an inner end portion 41 tightly fitting with the wall of the chamber 31, an annular inverted cone-shaped groove 42 in an intermediate section of the inner end portion 41, and an annular gasket 43 of soft plastic material fitting around the groove 42 to maintain tight contact with the inner wall of the pumping chamber 31 of the elongate block 30 of the cap 3.

Figure 3:
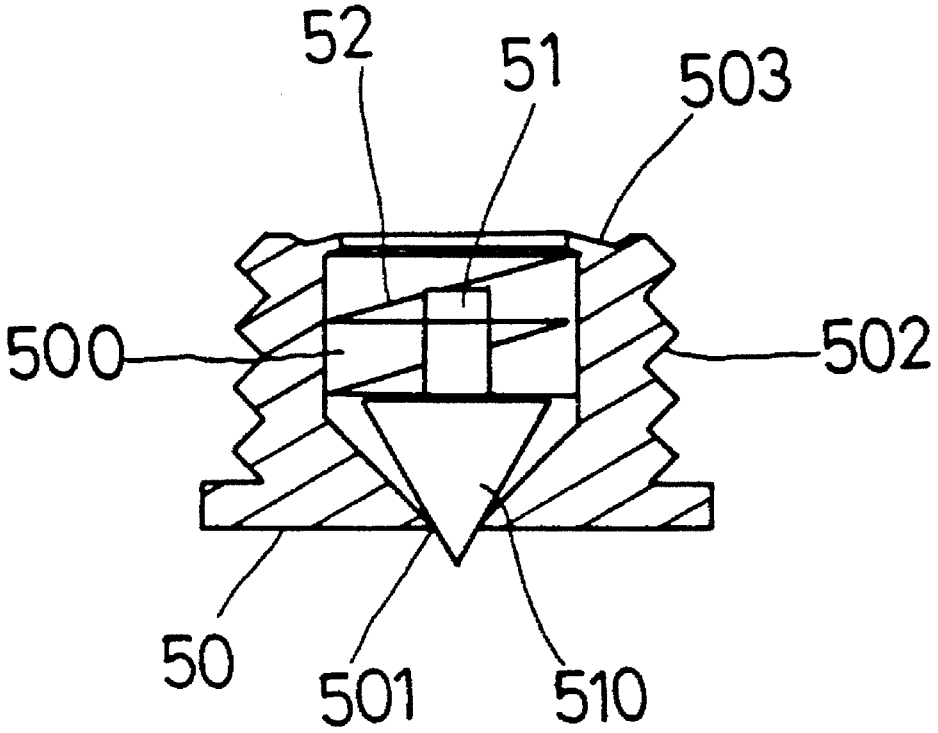
FIG. 3 is a cross-sectional view of an air valve in the adjustable sealed can in the present invention.

The air valve 5 is deposited in the valve hole 32 of the elongate block 30 of the cap 3, and includes a cylindrical valve base 50, a center through round hole 500 in the valve base 50, a cone-shaped shaped opening 501 formed at the bottom of the through hole 500, a male thread 502 engaging the female thread 33 of the valve hole 32 a stopper 51 fitting in the through hole 500 and having an inverted cone-shaped lower end 510 configured for tightly engaging in the cone-shaped opening 501, and a spring 52 placed in the round hole 500 for elastically urging the upper end of the stopper 51 two projecting tips 503, 503 at top of the hole 500 prevent the spring 52 from leaving the hole 500, as shown in FIG. 3.

The anti-leak gasket 6 is fitted around the inner top of the cap 3 thus, preventing the air outside from flowing into the can body 1, after the cap 3 is closed on top of the can body 1.

Figure 2:
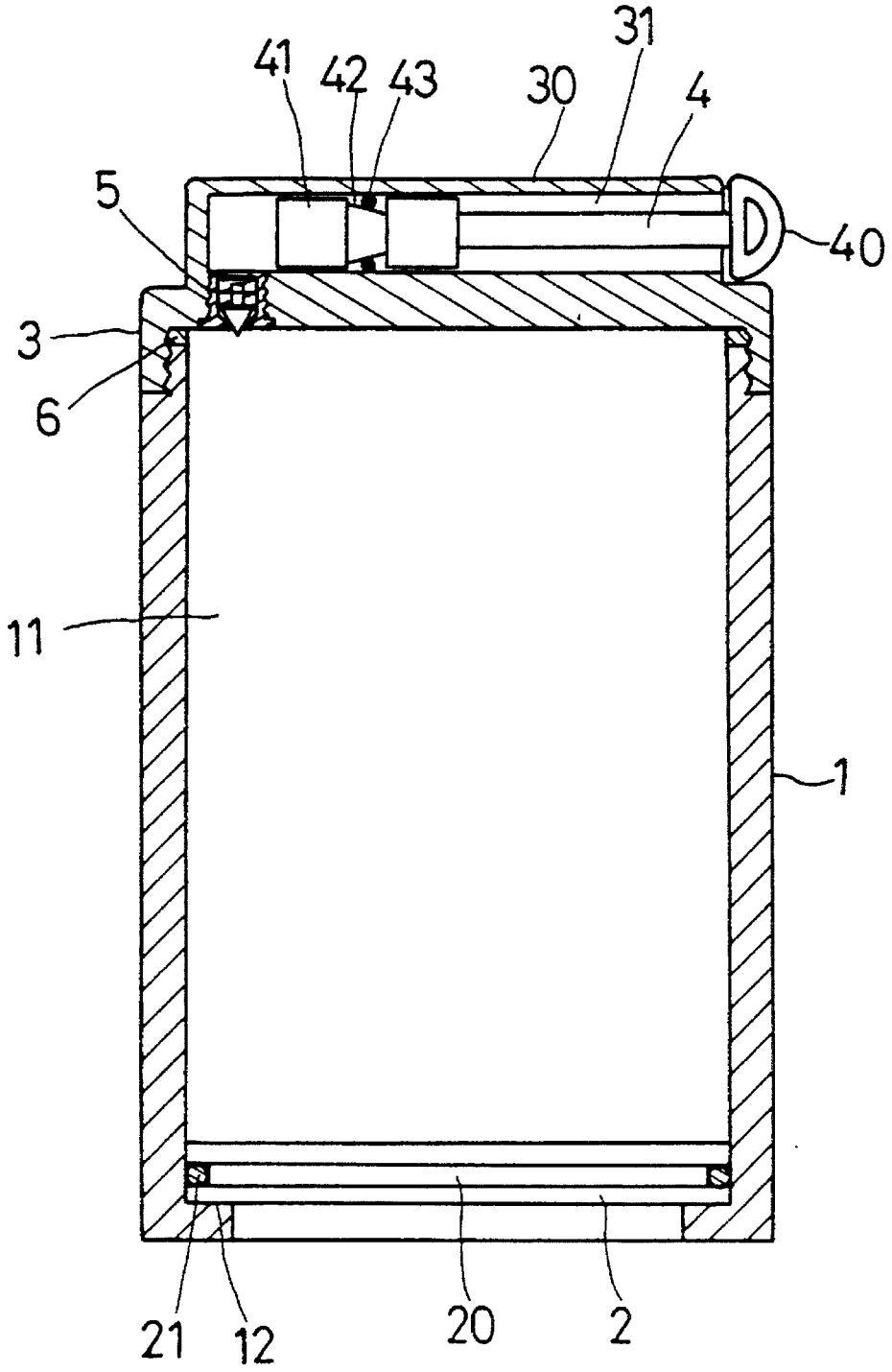
FIG. 2 is a cross-sectional view of the adjustable sealed can in the present invention.

In assembling, as shown in FIG. 2, the movable bottom plate 2 is first placed into the hollow interior 11 which is closed by the cap 3 and the movable bottom plate 2, the latter resting on the stop wall 12. Next, the pumping rod 4 is inserted in the pumping chamber 31 of the cap 3, and the air valve 5 is screwed in the through hole 32 of the cap 3. Then the anti-leak gasket 6 is put at the top of the female thread 33 of the cap. Finally, the cap 3 is screwed into the male thread 10 of the can body 1.

Figure 4:
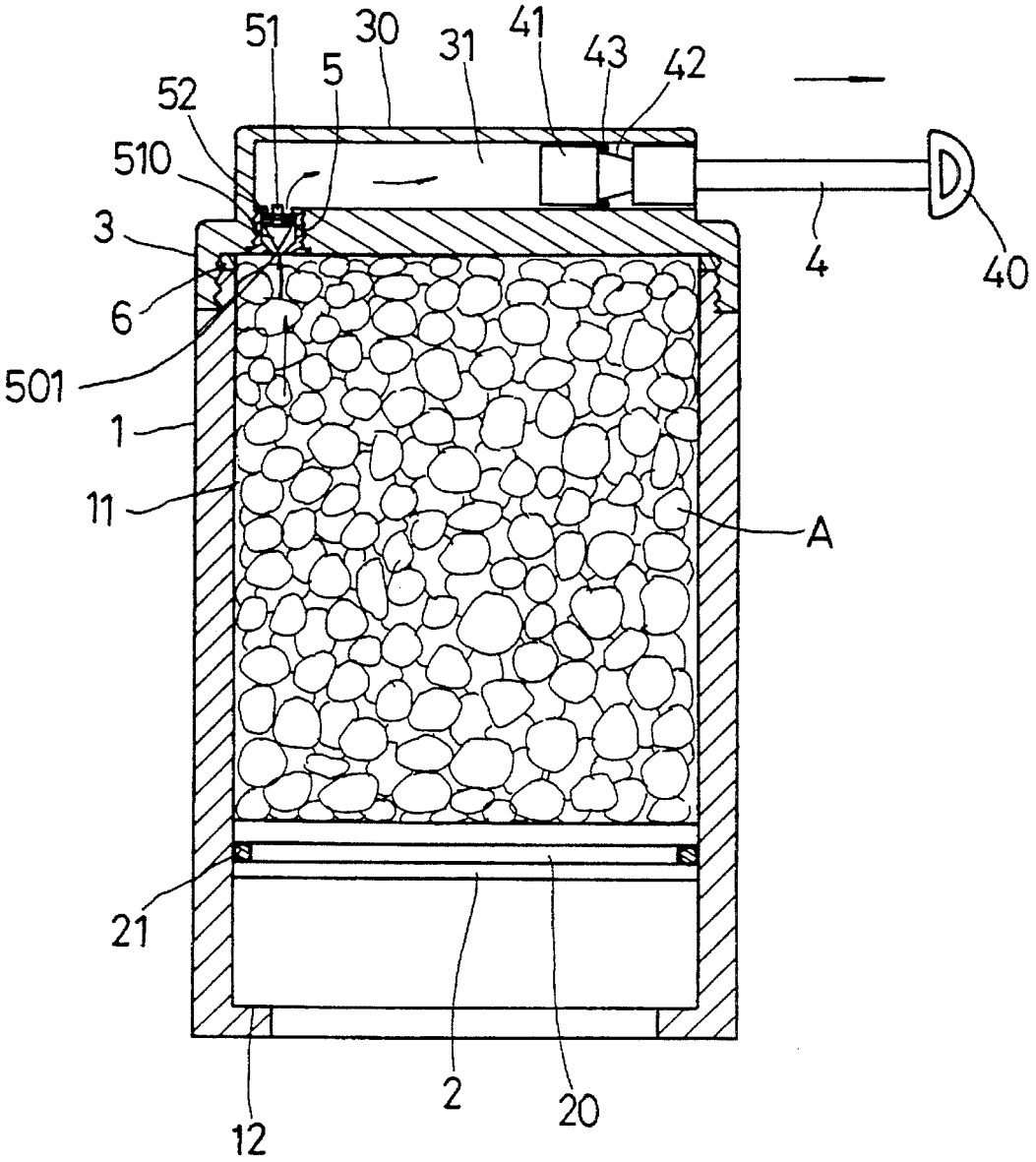
FIG. 4 is a cross-sectional view of the adjustable sealed can in the present invention, showing air flowing direction when a pumping rod is fully extended.
Figure 5:
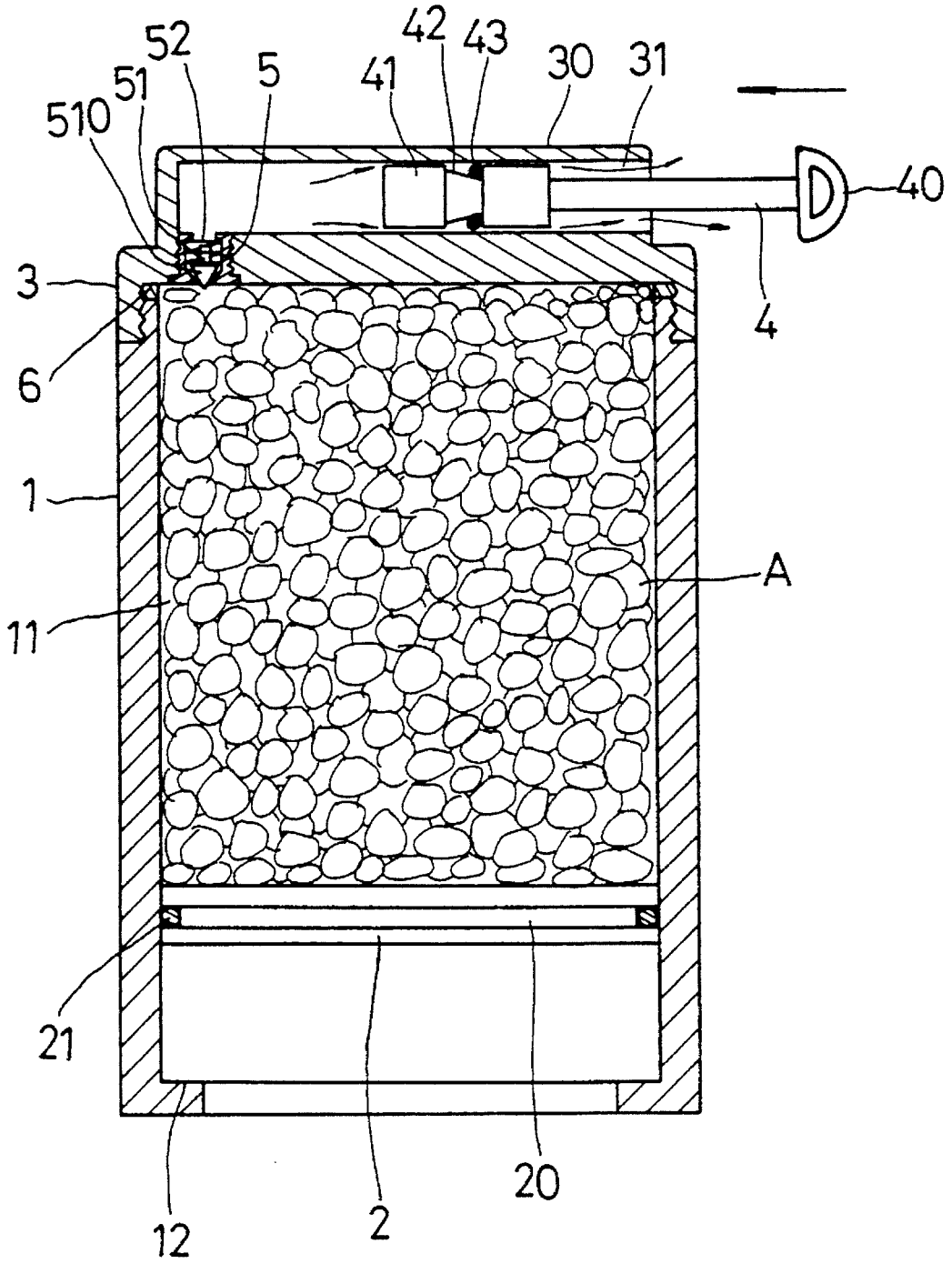
FIG. 5 is a cross-sectional view of the adjustable sealed can in the present invention, showing air flowing direction when the pumping rod is partially retracted after having been fully extended.

In using, the cap 3 is loosened off the can body 1, and food or the like A is placed in the chamber 11 of the can body 1. In case the chamber 11 is not completely filled with the food A, the movable bottom plate 2 can be continuously pushed up manually until the upper side of the food A reaches the upper opening of the can body 1. Then the cap 3 is closed on the can body 1, screwed tightly with little air remaining in the chamber 11. After that, the pimping rod 4 is pulled outward with the grip 40 held manually as shown in FIG. 4, forcing the air in the chamber 11 to flow past the stopper 51 and through the opening 501 into the pumping chamber 31 of the block 30 of the cap 3. At the same time, the gasket 43 of the pumping rod 4 is moved to rest at the left side of the annular inverted cone-shaped groove 42, thus preventing the air in the pumping chamber 31 from flowing outward therethrough. Then the pumping rod 4 is pushed inward, as shown in FIG. 5, forcing the air in the chamber to push the stopper 51 to block the opening 501 with the cone-shaped lower end 510 of the stopper 51, thus preventing the air from flowing back into the chamber 11 of the can body 1, and at the same time the gasket 43 is pushed to rest at the left side of the annular groove 42, thus permitting the air to flow out through a gap between the inner end portion 41 and the pumping chamber 31. So reciprocating movement of the pumping rod 4 can pump out the air in the chamber 11, which then becomes nearly vacuum. Since the pressure in the can body 1 and that outside the can body 1 are different, with the spring 52 having elasticity, the cone-shaped lower end 510 of the stopper 51 is pushed down to tightly block the opening 510. And the chamber 11 is tightly sealed from the cap 3 with the anti-leak gasket 6, and the gasket 21 of the bottom plate 2 is also tightly sealed against the of wall the chamber 11 hereby, keeping the chamber 11 in a nearly vacuum condition, and maintaining the food or the like in fresh condition. If the food A kept in the can body 1 is desired to be taken out, the cap 3 off the can body 1 may be loosened and removed.

From the above description, it may be understood that this invention has the following advantages.

1. It can effectively remove the air in the can body, which can then become nearly vacuum, thus preserving food kept therein in a fresh condition for a long time.

2. It can be used with ease and simplicity.

What is claimed is:

1. An adjustable sealed can comprising:

a can body having an upper opening, a bottom opening, a hollow interior, and an inwardly extending annular bottom wall defining the bottom opening;

a movable bottom plate sized to fit laterally in the hollow interior of said can body, the plate including a circumferential groove for an annular gasket to fit therein;

a cap for closing the upper opening of said an body, the cap having an elongated block on top, said block having a longitudinal hollow pumping chamber, said longitudinal hollow chamber arranged transversely across the top of said cap, and a valve hole at an inner end of said pumping chamber;

a pumping rod fitting closely in said pumping chamber of said elongated block of said cap, the rod having a grip at an outer end, and an inner end portion provided with an annular groove for receiving an annular gasket;

an air valve fitting vertically in said valve hole of said elongated block of aid cap, the air valve including a cylindrical valve base, a stopper and a spring, said valve base having a center through hole with a cone-shaped lower opening, said stopper fitting in said through hole and elastically maintained therein by said spring;

an anti-leak gasket fitting around an inner upper wall of said cap; and said movable bottom plate being movable upwardly from said annular bottom wall of said can body to force air in said can body to flow out through said air valve into said pumping chamber in said block of said cap, and said pumping rod in said pumping chamber being reciprocable to pump the air out from said pumping chamber to establish a substantially vacuum condition in the can body for keeping food stored therein fresh for a long time.

2. The adjustable sealed can as claimed in claim 1, wherein said annular groove of said pumping rod is shaped as an inverted cone.

3. The adjustable sealed can as claimed in claim 1, wherein said air hole in said elongate block of said cap is shaped as an inverted cone.

4. The adjustable sealed can as claimed in claim 1, wherein said valve base of said air valve has two sidewise projections at an upper inner wall for preventing said spring from slipping out of the center hole of said valve base.

5. The adjustable sealed can as claimed in claim 1, wherein said stopper of said air valve has a lower inverted cone-shaped portion.

* * * * *